US012807396B2

(12) United States Patent
Berkowitz et al.

(10) Patent No.: US 12,807,396 B2
(45) Date of Patent: Nov. 24, 2026

(54) PUNCHING BAG PACKAGE

(71) Applicant: Hykso Inc., Costa Mesa, CA (US)

(72) Inventors: Gregor Angus Berkowitz, San Francisco, CA (US); Alexandre Marcotte St-Miche, Costa Mesa, CA (US); Doug Hoang, Costa Mesa, CA (US); Daniel Robert Norris, Colorado Springs, CO (US); Michael Joseph Reickerd, San Jose, CA (US)

(73) Assignee: Hykso Inc., Costa Mesa, CA (US)

( * ) Notice: Subject to any disclaimer, the term of this patent is extended or adjusted under 35 U.S.C. 154(b) by 0 days.

(21) Appl. No.: 18/809,749

(22) Filed: Aug. 20, 2024

(65) Prior Publication Data

US 2026/0054914 A1 Feb. 26, 2026

(51) Int. Cl.

| | |
|---|---|
| ***B65B 5/12*** | (2006.01) |
| ***A63B 69/20*** | (2006.01) |
| ***B65D 85/00*** | (2006.01) |

(52) U.S. Cl.

CPC ..... *B65D 85/54* (2013.01); *A63B 69/20* (2013.01); *B65B 5/12* (2013.01)

(58) Field of Classification Search

USPC ..... 53/396

See application file for complete search history.

(56) References Cited

U.S. PATENT DOCUMENTS

| | | | | |
|---|---|---|---|---|
| 5,046,724 | A | 9/1991 | Sotomayer | |
| 6,251,051 | B1 | 6/2001 | Chen | |
| 7,226,398 | B2 * | 6/2007 | Fu | A63B 69/224 482/85 |
| 7,766,799 | B1 * | 8/2010 | Chen | A63B 69/224 482/85 |
| 2013/0331235 | A1 * | 12/2013 | Fields | A63B 69/22 482/83 |

OTHER PUBLICATIONS

International Search Report and Written Opinion of the International Searching Authority mailed Oct. 30, 2025 in related PCT application No. PCT/US25/42568, (11 pgs).

* cited by examiner

*Primary Examiner* — Chinyere J Rushing-Tucker

(74) *Attorney, Agent, or Firm* — Michael North

(57) ABSTRACT

Systems and methods for improving the packaging of a punching bag are provided to reduce shipping size when sent to a customer. The punching bag components may be distributed within the package in accordance with a variety of different arrangements including a punching bag segment grouped arrangement or a punching bag segment distributed arrangement. In certain embodiments, at least one component may be nested within another component within the package.

7 Claims, 12 Drawing Sheets

BAG PACKAGING
Segment Grouped

UPPER SEGMENT OF BAG

MIDDLE SEGMENT OF BAG

LOWER SEGMENT OF BAG

BAG PACKAGING
Segment Grouped

BAG PACKAGING
Segment Distributed

EXAMPLE OF BAG PACKAGING

PUNCHING BAG PACKAGE

BACKGROUND

A. Technical Field

The present disclosure relates generally to systems and methods for packaging a punching bag to enable cost-effective shipping to a purchaser. More particularly, the present disclosure relates to a packaging architecture in which a stabilized punching bag, including all of its components, may be shipped in a single package that is smaller than a corresponding assembled punching bag.

B. Background

Physical fitness equipment has transitioned to support a more dynamic workout routine in which a user may exercise in a gym, at home, or other location. Oftentimes a particular piece of fitness equipment, such as a punching bag, is designed for gym use where the environment is noisy and individuals around the equipment are not bothered by its loud operation. Transitioning these types of training equipment for home use presents certain challenges, including noise reduction, mechanical stability and cost-effective shipping to accommodate home use.

Exercise bags come in different sizes, shapes, and structures, including self-supporting free-standing bags that are suspended above a floor or rest on the floor. Generally, punching bags help users to develop and hone a variety of striking skills through practice that involves repetitively striking a relatively hard surface that results in conditioning and strengthening muscles, tendons, and bones of a user's hands, feet, or limbs.

One major shortcoming of conventional free-standing training equipment designs, such as those used in martial arts-type applications, is that they are mounted on a supporting hollow plastic base that are filled with at least 250 lb. and up to 450 lb. or more sand or water to balance the device. These plastic bases oftentimes move and create noise in response to a punch or a kick being applied to the bag. This mechanical instability and noise results in a less desirable deployment of the exercise equipment within a home environment. These prior art structures are also large and cumbersome such that shipping to a customer may be an issue.

Transporting, handling, and storing heavy training equipment is an expensive, time-consuming, cumbersome, and user-unfriendly undertaking that deters potential consumers from purchasing and setting up such devices in the first place, especially for home use. Another challenge is the cost of shipping a punching bag to a purchaser can oftentimes be prohibitive. In addition, the size of a punching bag can also present other issues in shipping due to its large size and weight.

Accordingly, it would be desirable to have systems and methods that overcome the above-mentioned limitations and provide a punching bag that can be efficiently shipped to a purchaser.

BRIEF DESCRIPTION OF THE DRAWINGS

References will be made to embodiments of the invention, examples of which may be illustrated in the accompanying figures. These figures are intended to be illustrative, not limiting. Although the invention is generally described in the context of these embodiments, it should be understood that it is not intended to limit the scope of the invention to these particular embodiments. Items in the figures are not necessarily to scale.

DETAILED DESCRIPTION OF EMBODIMENTS

Figure 1:
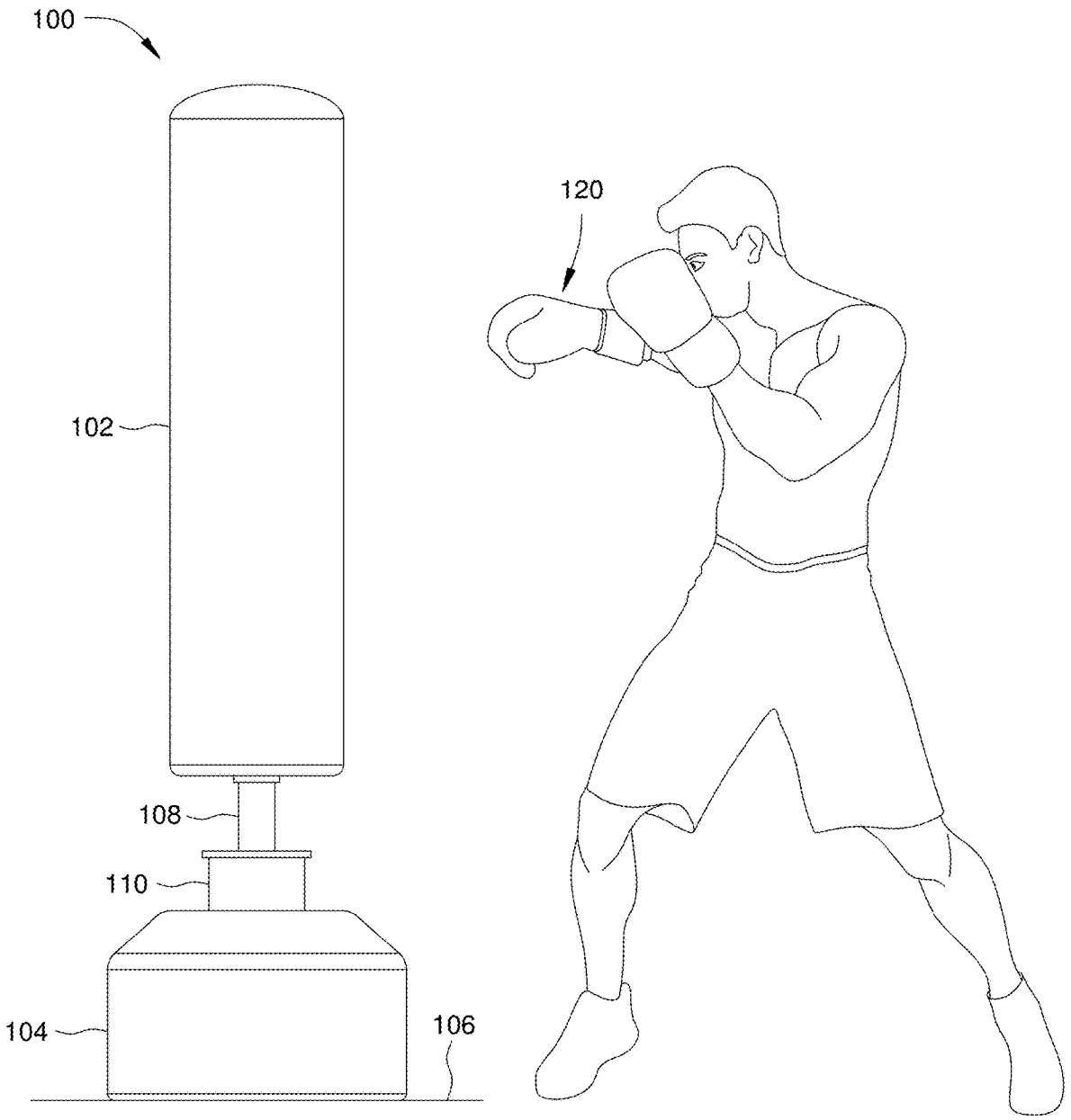
FIG. 1 (PRIOR ART)
FIG. 1 is a side view of a commonly available free-standing-type punching bag assembly in its resting position.

In the following description, for purposes of explanation, specific details are set forth in order to provide an understanding of the invention. It will be apparent, however, to one skilled in the art that the invention can be practiced without these details. Furthermore, one skilled in the art will recognize that embodiments of the present invention, described below, may be implemented in a variety of ways, such as a process, an apparatus, a system, a device, or a method of distributing components within a package.

Components, or modules, shown in diagrams are illustrative of exemplary embodiments of the invention and are meant to avoid obscuring the invention. It shall also be understood that throughout this discussion that components may be described as separate functional units, which may comprise sub-units, but those skilled in the art will recognize that various components, or portions thereof, may be divided into separate components or may be integrated together, including integrated within a single system or component. It should be noted that functions, movements or operations discussed herein may be implemented in a variety of different components.

Furthermore, connections between components or systems within the figures are not intended to be limited to direct connections. Rather, these components may be modified, re-formatted, or otherwise changed by intermediary components such that connections allow a variety of different movements and functions. Also, additional or fewer connections may be used. It shall also be noted that the terms "coupled" or "connected," shall be understood to include direct connections, indirect connections through one or more intermediary devices such that a desired function is achieved.

Reference in the specification to "one embodiment," "preferred embodiment," "an embodiment," or "embodiments" means that a particular feature, structure, characteristic, or function described in connection with the embodiment is included in at least one embodiment of the invention and may be in more than one embodiment. Also, the appearances of the above-noted phrases in various places in the specification are not necessarily all referring to the same embodiment or embodiments.

The use of certain terms in various places in the specification is for illustration and should not be construed as limiting. A service, function, or resource is not limited to a single service, function, or resource; usage of these terms may refer to a grouping of related services, functions, or resources, which may be distributed or aggregated.

The terms "include," "including," "comprise," and "comprising" shall be understood to be open terms and any lists the follow are examples and not meant to be limited to the listed items. Any headings used herein are for organizational purposes only and shall not be used to limit the scope of the description or the claims. Each reference mentioned in this patent document is incorporate by reference herein in its entirety.

Furthermore, one skilled in the art shall recognize that: (1) certain steps may optionally be performed; (2) steps may not be limited to the specific order set forth herein; (3) certain steps may be performed in different orders; and (4) certain steps may be done concurrently.

Furthermore, it shall be noted that embodiments described herein are given in the context of punching bags for martial arts, but one skilled in the art shall recognize that the teachings of the present disclosure are not limited since a training bag may be used by any person who physically strikes a training bag using a body part or object, such as a tool, weapon, or other instrument. Therefore, the disclosure encompasses applications that do not need necessarily be related to martial arts or boxing applications, i.e., various embodiments may equally be used in other contexts.

In this document, the terms "training bag" and "punching bag" refer to a practice device that serves as a target to which a force is applied such as an individual throwing a punch or kicking the bag, e.g., for practicing martial arts or other activities.

FIG. 1 depicts a commonly available free-standing-type punching bag assembly in its resting position. Punching bag assembly 100 comprises top portion 102 having a cylindrical shape, shaft 108, and base 104 that rests on floor 106. As shown in FIG. 1, shaft extends from top portion top 102 and is coupled to base 104 by coupling means 110. In certain instances, prior art punching bag assembly 100 may be separated into the top portion 102 and base 104; however, dividing the assembly 100 into small components is not currently available. The resulting combined structure acts as a relatively rigid single body having a greatly uneven mass distribution along its axis (not shown). One skilled in the art will recognize the challenges in shipping such a bag to a customer including its size and overall cost to send via mail, FedEx and other shipping means.

Top portion 102 of punching bag assembly 100 typically consists of some type of cushioning material, e.g., a foam body encapsulated by a vinyl cover. Base 104 is fillable with typically hundreds of pounds of filling material, e.g., through a relatively small opening port into which the user must pour sand or water in what amounts to a cumbersome user-unfriendly maneuver. This difficulty in filling the base alone deters a great number of potential consumers from purchasing and setting up punching bag assembly 100 and for more sophisticated equipment, which comprises feedback sensors such as motion trackers and other measurement devices, also drastically increases subscription activation time. In addition, shipping the punching bag assembly 100 may become cost prohibitive given the relative large sizes and weights of the top portion 102 and the base 104.

In operation, once a user applies a force in the form of kinetic energy to an area of top portion 102, e.g., by a strike or kick with object 120, shaft 108 that extends through top portion 102 will transform that force, at least in part, into angular momentum resulting in a rotational force. The rotational force will accelerate top portion 102 away from object 120 due to a torque that is developed and, if sufficiently great, will cause one side of base 104 to lift off floor 106 by some angle.

Typically, the amount of lift is proportional to the force exerted on punching bag assembly 100. Once the force applied to top portion 102 is released, the relatively heavy (e.g., 450 lbs.) base 104 that was lifted will be pulled back by a gravitational force and, thus, accelerate back towards floor 106. Once base 104 lands back on floor 106, an undesirable audible noise will be created upon impact. After rocking back and forth in an oscillatory movement during a settling time, top portion 102 will resume its original position shown in FIG. 1, unless a subsequent force is applied to top portion 102 prior to that. Unwanted noise may be generated each time top portion 102 experiences a relatively strong punch whose force is sufficiently large to lift base 104 off floor 106, making existing training bag designs, such as punching bag assembly 100, impractical for home use. Existing attempts to mitigate this include requiring additional acoustic damping material to be placed underneath base 104 to absorb the force and, thus, reduce noise.

Another shortcoming aside from base 104 slamming on floor 106 is that base 104 also tends to slide across floor 106, opposite to the direction the punch is applied. This resulting lateral motion largely depends on the surface material of floor 106, i.e., the relative friction between the surface material of floor 106 and the surface material of base 104. This unwanted side-effect and the fact that the user has to repeatedly move the entire weight of punching bag assembly 100 back to its original position on floor 106. Users typically perceive such undesirable side-effects as disrupting their workout experience.

Further, the weight of punching bag assembly 100 makes it difficult to move punching bag assembly 100 to a storage location, e.g., each time when it is not in use. Furthermore, while the overall punching bag assembly 100 is very heavy due to the weight of base 104 when base 104 is properly filled, top portion 102, which is made of light-weight foam material, is relatively light. However, light-weight top portion 102 results in a different and less desirable punch-feel when compared to a common heavy ceiling-mounted sand-filled leather punching bag.

In detail, top portion 102 is relatively loosely secured to punching bag assembly 100 in a manner such as to cause the user to feel a relatively large amount of deflection that greatly differs from the feel of punching a heavy ceiling-mounted sandbag. This mainly due to the fact that, unlike the inertia of a heavy punching bag, which provides a relatively large resistance to the force that is exerted by the user and absorbed by the training bag, top portion 102 of punching bag assembly 100 provides inadequate training resistance. This phenomenon is exacerbated with increasing force applied to top portion 102. This shortcoming renders punching bag assembly 100 unsuitable for advanced and professional use.

In contrast, embodiments herein advantageously provide the punch-feel of training with a common heavy ceiling-mounted sand-filled leather punching bag. At the same time, this aids users to build and maintain more muscle tissue than is possible with existing free-standing training bag designs. Advantageously, various embodiments accomplish this while reducing the risk of wrist or ankle injuries, typically associated with striking a heavy or dense training bag with high impact. In addition and will be discussed later, fillable bags may be provided herewith to provide an easier way in which the base is filled with material as well as provide extra protection from leakage from the base.

Figure 2A:
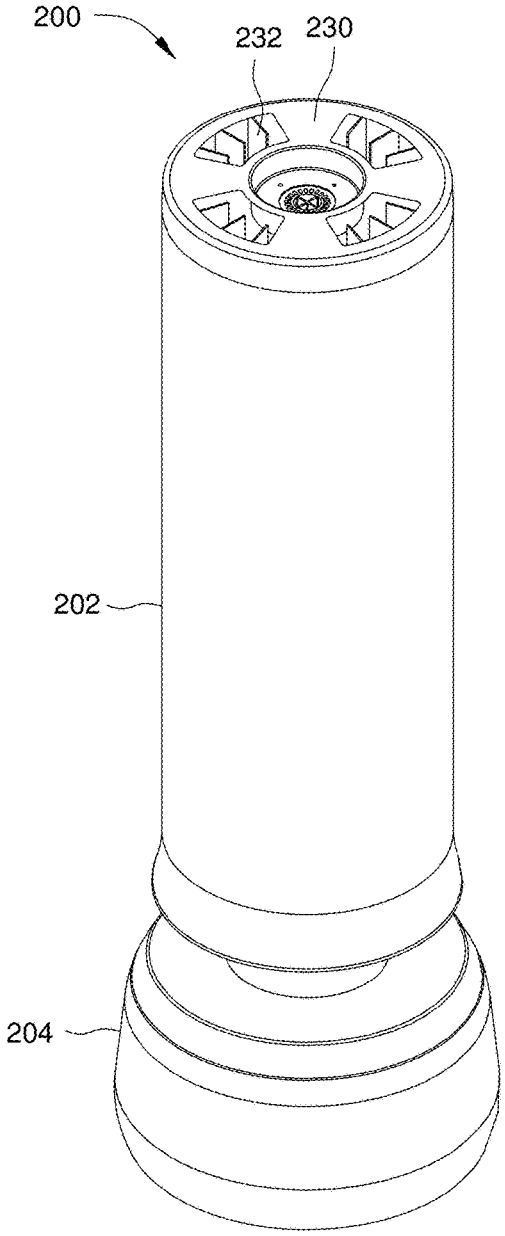
FIGS. 2A and 2B are perspective views of a training bag assembly, according to various embodiments of the present disclosure.
Figure 2B:
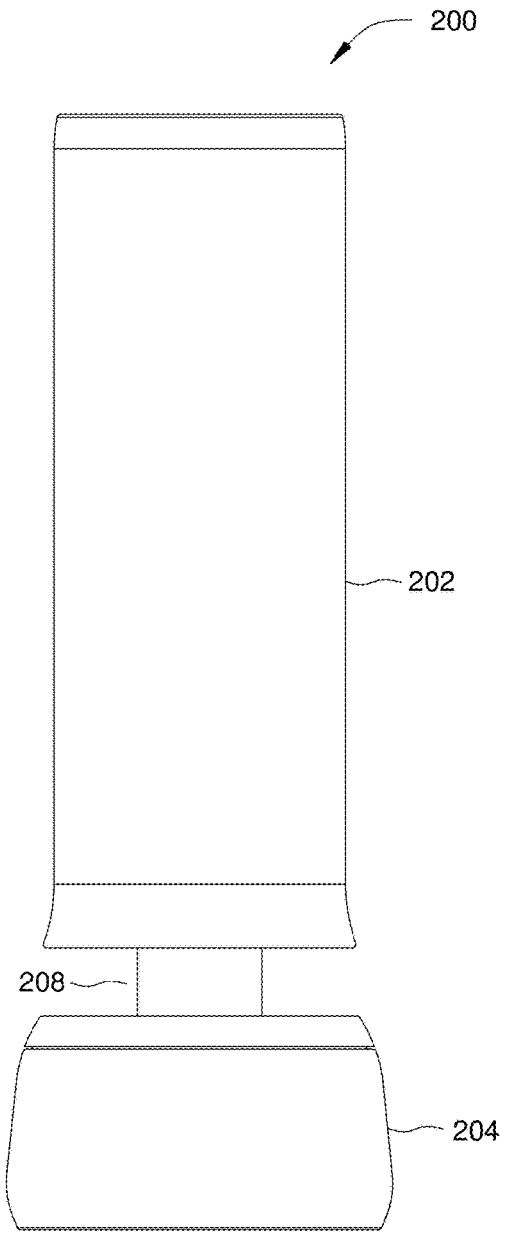

FIG. 2A is a perspective view of a training bag assembly, and FIG. 2B is a side view of a training bag assembly, according to various embodiments of the present disclosure. In embodiments, training bag assembly 200 comprises top portion 202, shaft assembly 208, and base 204. Top portion 202 may comprise any suitable durable material, such as plastic, nylon, polycarbonate that has high-impact resistance, high elasticity, and other desirable mechanical, chemical, and other properties. Suitable properties include mechanical and acoustic damping, elasticity, and a lack of hysteresis effects. As an example, top portion 202 may comprise a relatively rigid polymer material, such as a thermoplastic elastomer, e.g., thermoplastic polyurethane (TPU) that may be combined with resilient foam material to provide additional padding to top portion 202. Such polymers may be advantageously implemented into a striking area of top portion 202 to absorb energy during operation.

In embodiments, base 204 may be produced from, e.g., a blow-molded plastic material, such as high-density polyethylene, to create a "hollow" enclosure that can hold a liquid, a gel, or any other suitable filling material or combination thereof. In operation, base 204 may be as a ballast that counterbalances the forces applied to top portion 202. A person of skill in the art will appreciate that for liquid or gel-like filling materials (e.g., elastomers), some, or all of base 204 may be hermetically sealed to prevent undesirable leakage. In certain embodiments of the invention, the punching bag 200 may be shipped with empty bags that can be filled with a substance, such as a liquid, a solid such as sand, or combination thereof. Accordingly, the base may contain sealed bags that provide additional protection against leaking of the substance as the bags provide a first containment device and the base 204 provides a second containment structure such that leakage from the base 204 would require puncturing both one or more bags and the base 204.

As discussed in greater detail below, the strategic combination of components from which training bag assembly 200 is constructed isolate base 204 from the rest of the bag. This, advantageously, inhibits unwanted motion, sound, and other side-effects associated with existing punching bag designs. Certain embodiments may accomplish this without having to procure and fill base 204 with, e.g., 300 lbs. or more filling material. In certain embodiments, base 204 may comprise an auxiliary bag ring (not shown) that may be located adjacent to the perimeter of base 204 to prevent base 204 from sliding across a slippery floor when top portion 302 is struck by a high-energy punch.

Figure 3A:
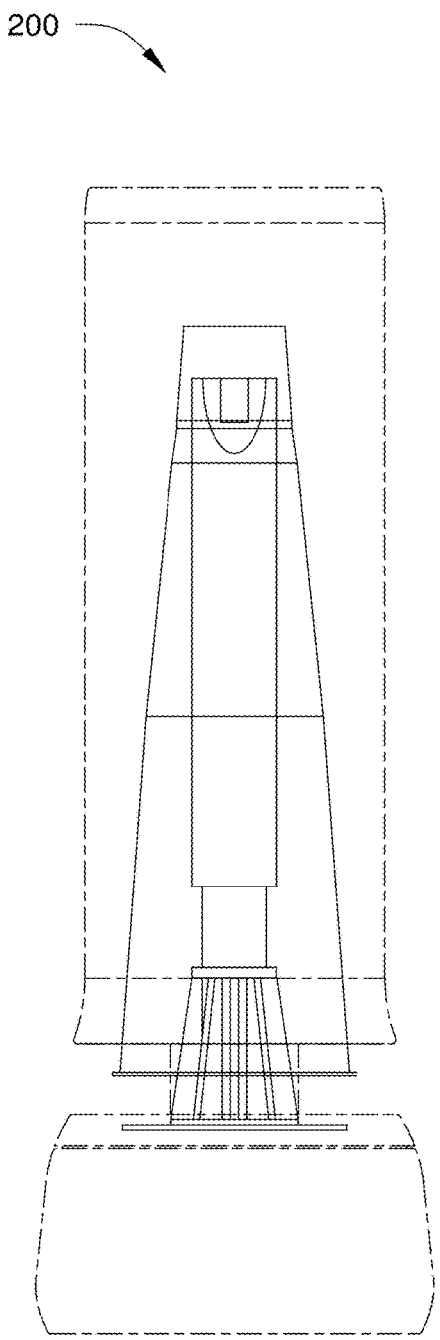
FIGS. 3A and 3B are side views of a training bag assembly, according to various embodiments of the present disclosure.
Figure 3B:
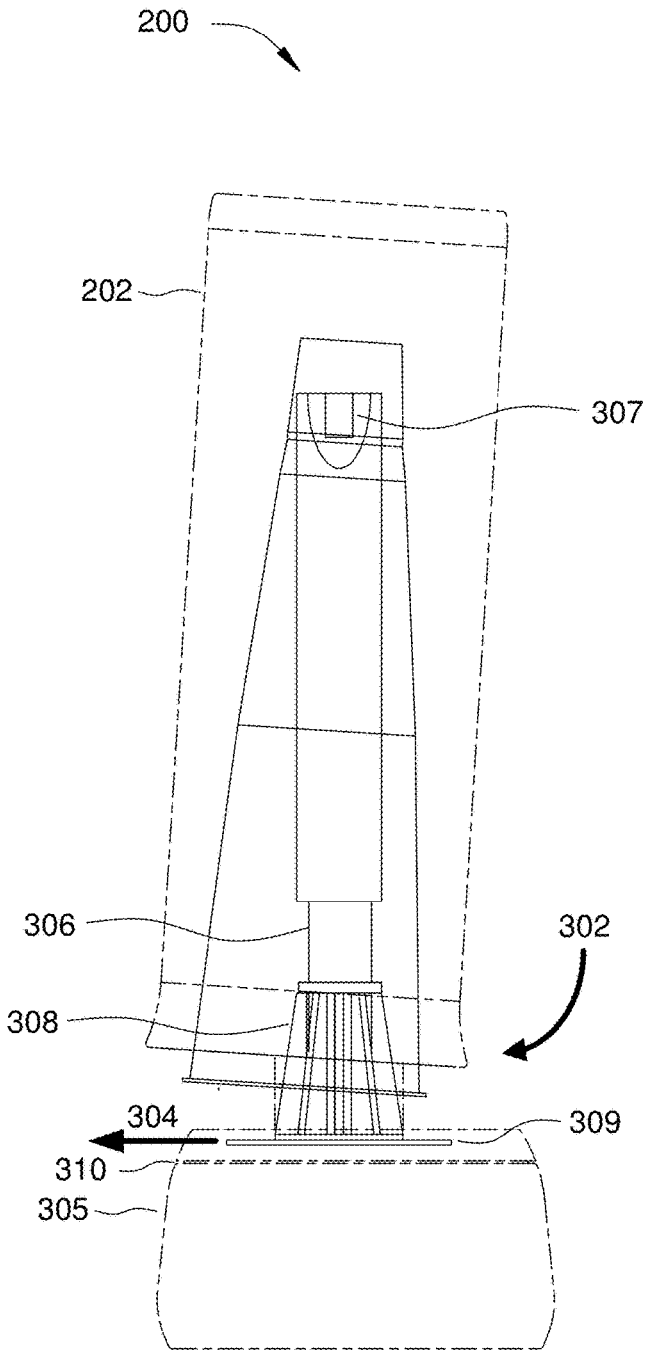

FIGS. 3A and 3B are exploded views of a training bag assembly, according to various embodiments of the present disclosure. In embodiments, training bag assembly 200 may comprise top portion 202, cone assembly 302, gimbal 307, shaft assembly 306, intermediate shaft spring 308, sliding plate 309, sliding plate cover 310, shaft spring 312, base top plate 314, and base 305. It is noted that components depicted in FIG. 3A need not necessarily be assembled in the order or orientation shown therein. For example, a person of skill in the art will appreciate that optional sliding plate cover 310 may be mounted to the top surface of sliding plate 309, facing base 305.

In embodiments, top portion 202 may be mounted on cone assembly 302, which in operation moves, along with shaft assembly 306, due to the operation of gimbal 307. In embodiments, gimbal 307 may be implemented as a two-axis gimbal. One person of skill in the art will appreciate that any other structure, such as a ball-and-socket structure, may equally be employed in lieu of two-axis gimbal 307. A person of skill in the art will further appreciate that gimbal 307 need not be limited to two-axis designs and may equally be implemented as a three-axis structure, e.g., to allow for a certain amount of travel in a third direction along the axis of shaft assembly 306. Furthermore, embodiments of the invention may use a spring that facilitates translational movement as well as two-axis rotation.

In embodiments, gimbal 307 may comprise high-stiffness fatigue and wear-resistant materials and may be positioned relatively close to one end of cone assembly 302 to allow top portion 202 to pivot around gimbal 307 to perform angular and/or translational movements similar to those of a traditional hanging punching bag. Similarly, shaft assembly 306 and intermediate shaft spring 308 may comprise relatively high-stiffness, high fatigue-resistant materials, such as metal (e.g., die cast aluminum) or TPU having a relatively high plastic content. This is understood that any material mentioned herein may be produced using any manufacturing process known in the art, such as a sintering or molding process, e.g., plastic injection molding.

In embodiments, intermediate shaft spring 308 may be implemented as having a conical structure that extends from the outer surface of shaft assembly 306 to sliding plate 309. Sliding plate 309 may be implemented as a low-friction component that acts as a part of a low-friction bearing, e.g., a ball bearing that comprises top of base plate 305. In embodiments, sliding plate cover 310 may comprise any number of recesses that may receive balls. The thereby formed ball bearing structure allows for low-friction longitudinal movement of sliding plate 309. In operation, sliding plate 309 travels by a certain amount determined, at least in part, by shaft spring 312, which restricts the motion of sliding plate 309. Once shaft spring 312, which may be mounted onto base top plate 314, decompresses, shaft spring 312 may cause shaft assembly 306, including sliding plate 309 to travel in direction of their neutral position, i.e., their position when training bag assembly 200 is not in use.

In embodiments, intermediate shaft spring 308 may serve as a damping device that, in operation, may absorb at least some of the energy transferred to top portion 202, e.g., by virtue of a strike to top portion 202, which may cause sliding plate 309 to travel and shaft 306 to compress spring 312. In embodiments, spring 308 may further absorb some of the energy, thus, reducing the amount of torque that would otherwise be transferred to base 305. As a result, base 305 may at least partially be isolated from top portion 202 and/or shaft assembly 306, i.e., from the effect of the force applied to the top portion 202. It is noted that both shaft spring 308 may be implemented from any material and in any arbitrary shape that can absorb energy and aid in isolating base 305 from top portion 202 and/or shaft assembly 306. For example, shaft spring 308 may be implemented as a progressive spring that exhibits greater stiffness and damping with increasing compression caused by the deflection of shaft assembly 306. In other embodiments, a pivot may be implemented instead of a shaft spring may be used to allow movement of the shaft. The pivot may also be used to lock the movement of the shaft assembly 306 if the bag is to be moved or re-positioned.

Overall, the combination of several components advantageously isolates base 305 at least partially from impact on rest of the training bag assembly 200. In addition, in embodiments, base 305 may comprise, or be placed adjacent to, a structure at least partially surrounds base 305, such as a base ring (not shown) that may comprise a number of sections, such as plastic stops that limit movement of base 305 across a slippery floor. Alternatively, a high-friction mat (also not shown) or equivalent may be placed underneath base 305 to restrict unwanted movement and the noise associated therewith.

In other embodiments, training bag assembly 200 need not comprise a sliding plate that moves on ball bearings located on a sliding plate cover that attached to base 305. Instead, in embodiments, training bag assembly 200 may comprise intermediate shaft spring 308 that may be mounted to a top surface of base 304, e.g., by a number of fasteners to restrict the motion of the bottom part of shaft spring 308. The shaft spring 308 may be implemented as having any geometry and material stiffness.

In operation, shaft spring 308 may absorb energy from lateral motions of shaft 306 without transferring all or any part of that energy to base 305, in effect, reducing the torque shaft spring 308 may that would otherwise transfer to base 305. In this manner, shaft spring 308 may isolate motions of shaft 306 from base 305 to a certain degree. Base 305 may thus be at least partially isolated from top portion 202 and/or shaft assembly 306, i.e., from the effect of the force applied to top portion 202. As previously described, the shaft spring may be replaced with a pivot in certain embodiments wherein the pivot allows locking and unlocking functionality of the punching bag.

It is understood that training bag assemblies 200 are not limited to the constructional detail shown there or described in the accompanying text. As those skilled in the art will appreciate, components may be combined in various configurations. Further, training bag assemblies may comprise any combination of components not expressly mentioned herein, such as couplers, fasteners, and other components helpful in accomplishing the objectives of the present disclosure. Furthermore, other geometries and materials having suitable mechanical properties may be used to implement the teachings of the present disclosure without departing from the spirit of the invention.

Given the size and weight of the punching bag assembly 200, shipping to customers may be cumbersome, heavy and expensive. Various embodiments of the invention illustrate different ways in which the punching bag assembly 200 may be separated and subsequently distributed into a single package to improve packaging performance. Once the package is received, the purchaser may assemble the punch bag 200.

Figure 4:
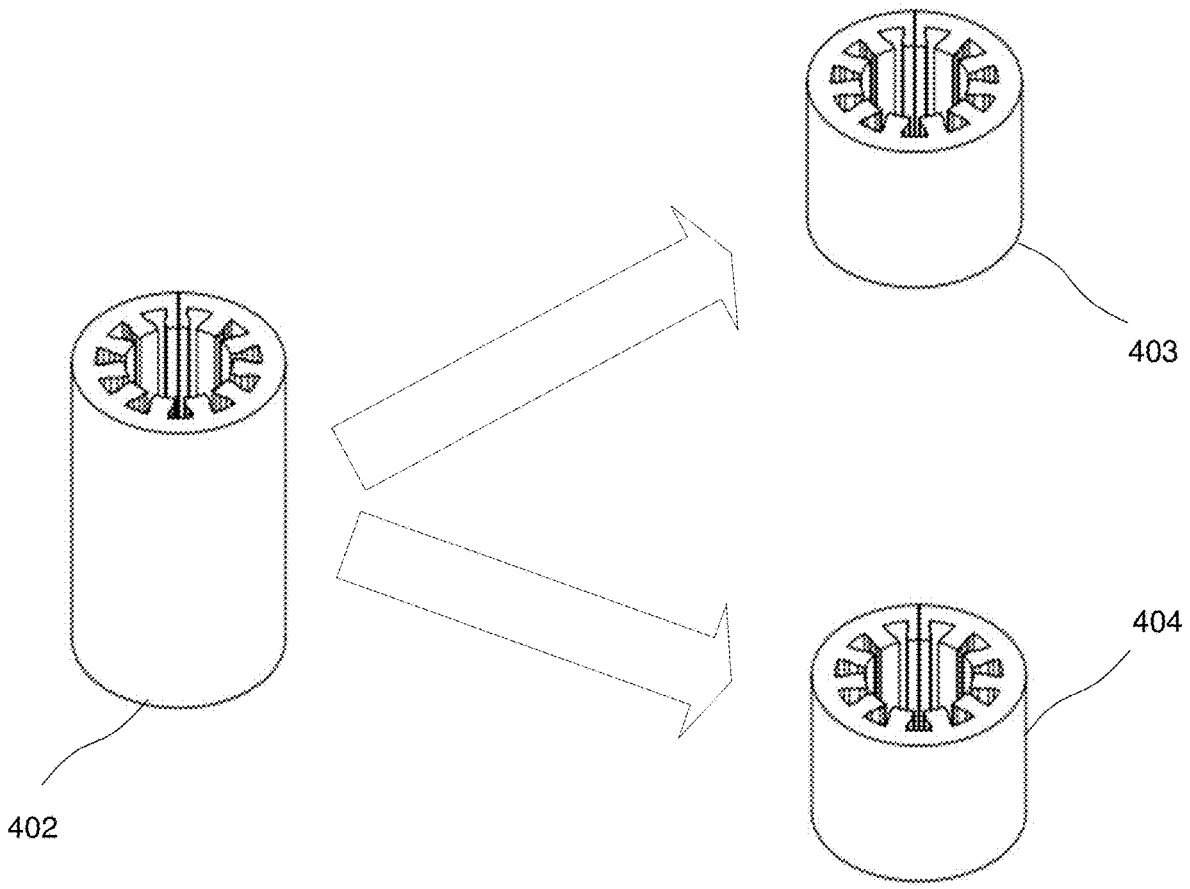
FIG. 4 is a view in which a punching bag's absorbing material is divided into two sections to enable improved shipping according to various embodiments of the present disclosure.

FIG. 4 depicts a first manner in which durable material 402 is partitioned to allow improved packaging. This durable material 402 wraps around an inner structure of the punching bag to provide a surface on which an individual can strike via a punch, kick, etc. As shown, durable material 402 is partitioned into a plurality of durable material components. In this example, durable material 402 is partitioned into a first durable material component 403 and a second durable material component 404. One skilled in the art will recognize that durable material 402 may be partitioned into any number of components to enable an improved punching bag package. One skilled in the art will recognize that the shape and material type within the durable material 402 may be different across different embodiments.

Figure 5:
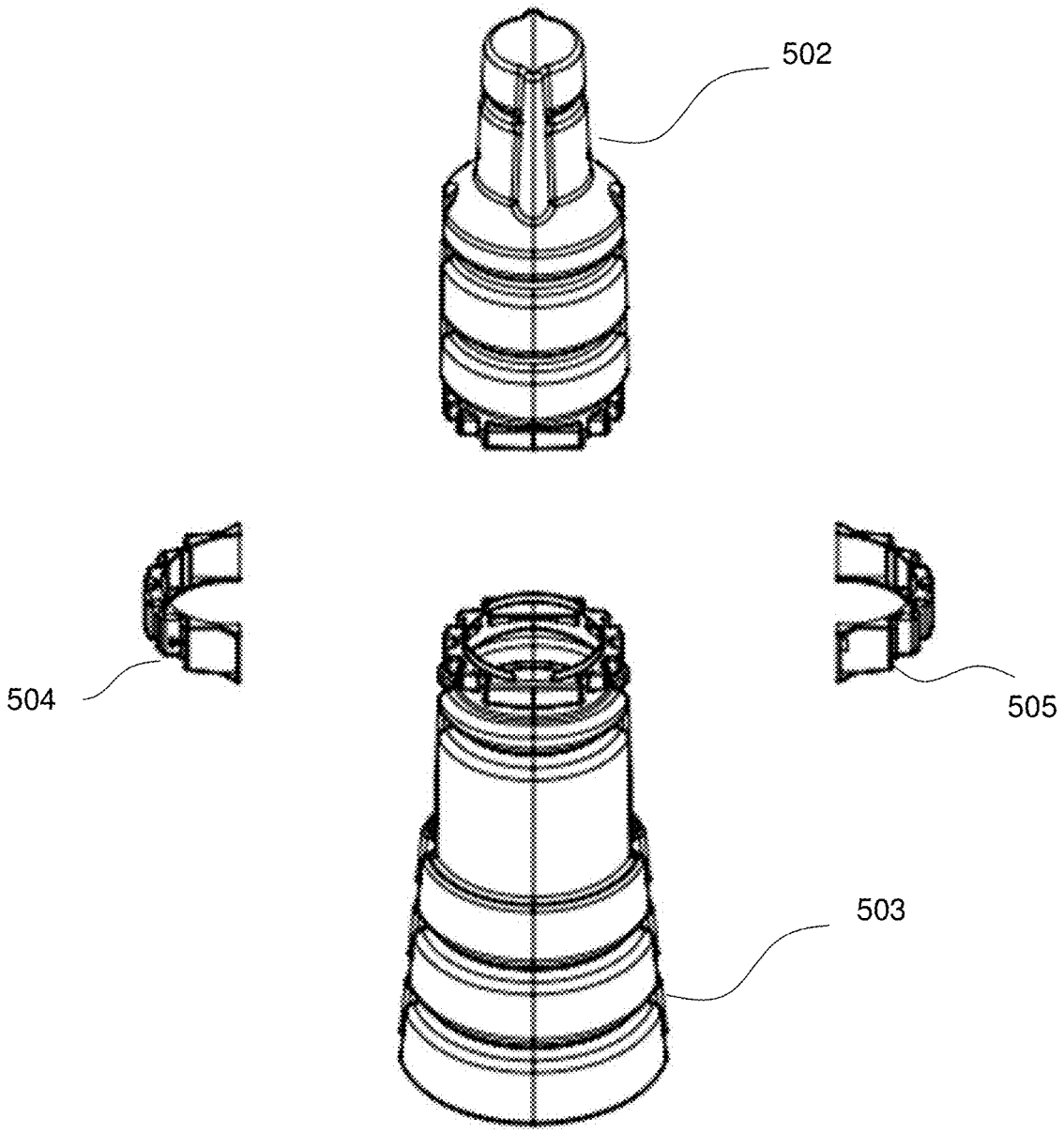
FIG. 5 is a view of a punching bag's internal housing around which absorbing material is positioned that enables improved shipping according to various embodiments of the present disclosure.

FIG. 5 illustrates a partitionable internal structure according to various embodiments of the invention. As discussed, the internal structure provides a support around which the durable material 402 is positioned. In this example, the internal structure is partitioned into a plurality of components to enable efficient packaging such that a lower bag holder 503 and upper bag holder 502 are separable. Also, a clamping structure comprising a first clamp element 504 and second clamp element 505 are provided to securely lock and unlock the lower bag holder 503 and upper bag holder 502 together. One skilled in the art will recognize that the internal structure may be partitioned into a variety of different components, all of which are consistent with embodiments of the invention.

The upper bag holder 502 may be further separated into components. In one embodiment, the upper bag holder 502 may be vertically divided into halves for placement within the package. Additionally, the upper bag holder 502 may be hollow to allow other components to be nested therein during shipping to further optimize spacial use within the package. Similarly, the lower bag holder 503 may also be vertically divided into halves for placement within the package in accordance with one embodiment of the invention. The lower bag holder 503 may also be hollow for nesting other components therein. One skilled in the art will recognize that these components may be divided into subcomponents in accordance with a variety of different manners and be partially or fully hollow to allow nesting of other components within the package.

Figure 6:
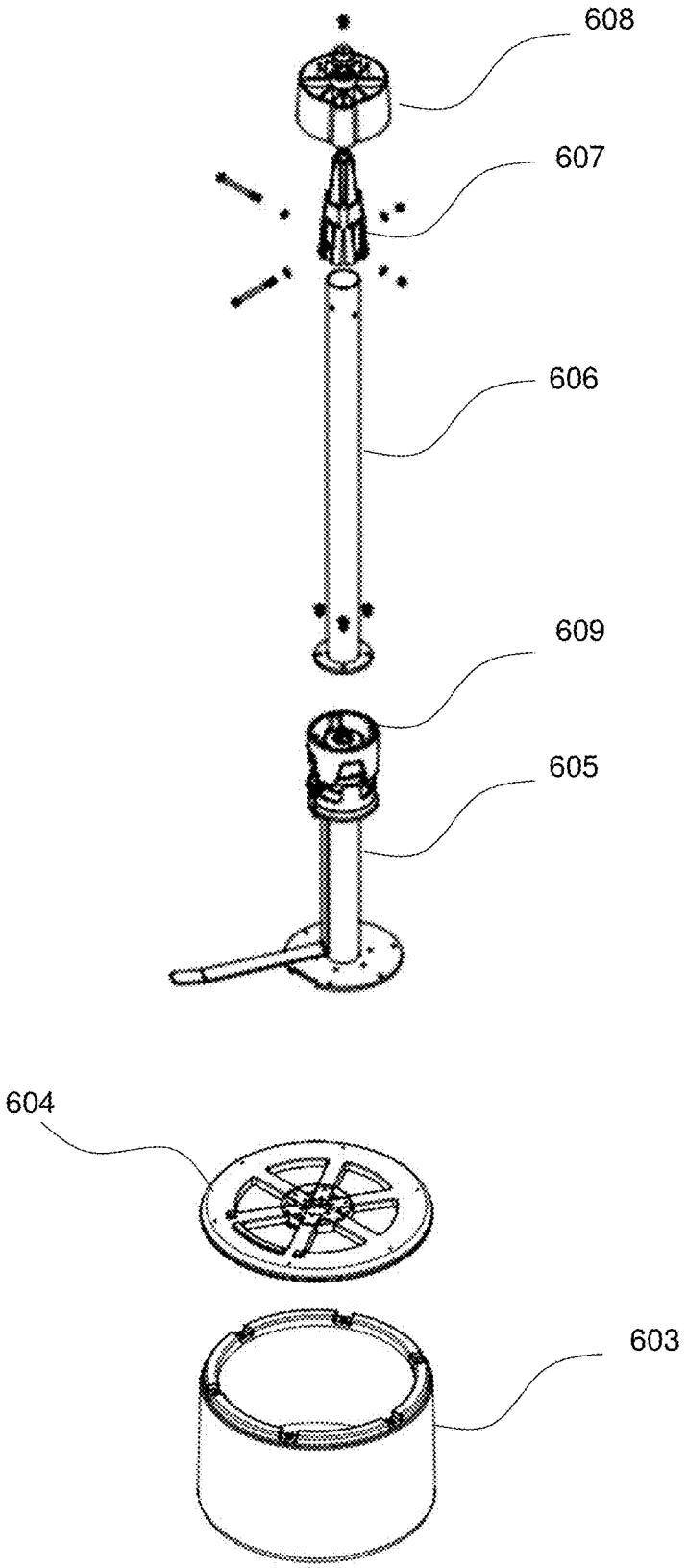
FIG. 6 is a view of a punching bag's base and vertical support that enables improved shipping according to various embodiments of the present disclosure.

FIG. 6 illustrates an internal support for the punching bag according to various embodiments of the invention. A portion of the internal support is positioned within the upper bag holder 502 and lower bag holder 503 to provide vertical stability to the punching bag. The internal support may be divided into a plurality of components to enable a preferred packaging that reduces the size of the punching bag for shipment to customers.

In this embodiment, the internal support comprises a gimbal 608, gimbal support 607, upper weldment 606, lower weldment 605, shaft spring 609, base top 604, and base 603. To enable a more spatially dense and reduced size of packaging for shipment to customers, these components may be separated and distributed within the package. In certain embodiments, at least one of these components is nested internally within another component to further reduce the overall size of the package. One skilled in the art will recognize that the internal structure may be separated into a variety of different components. Furthermore, one skilled in the art will recognize that these components may be distributed in a variety of ways within the package in accordance with various embodiments of the invention.

Figure 7:
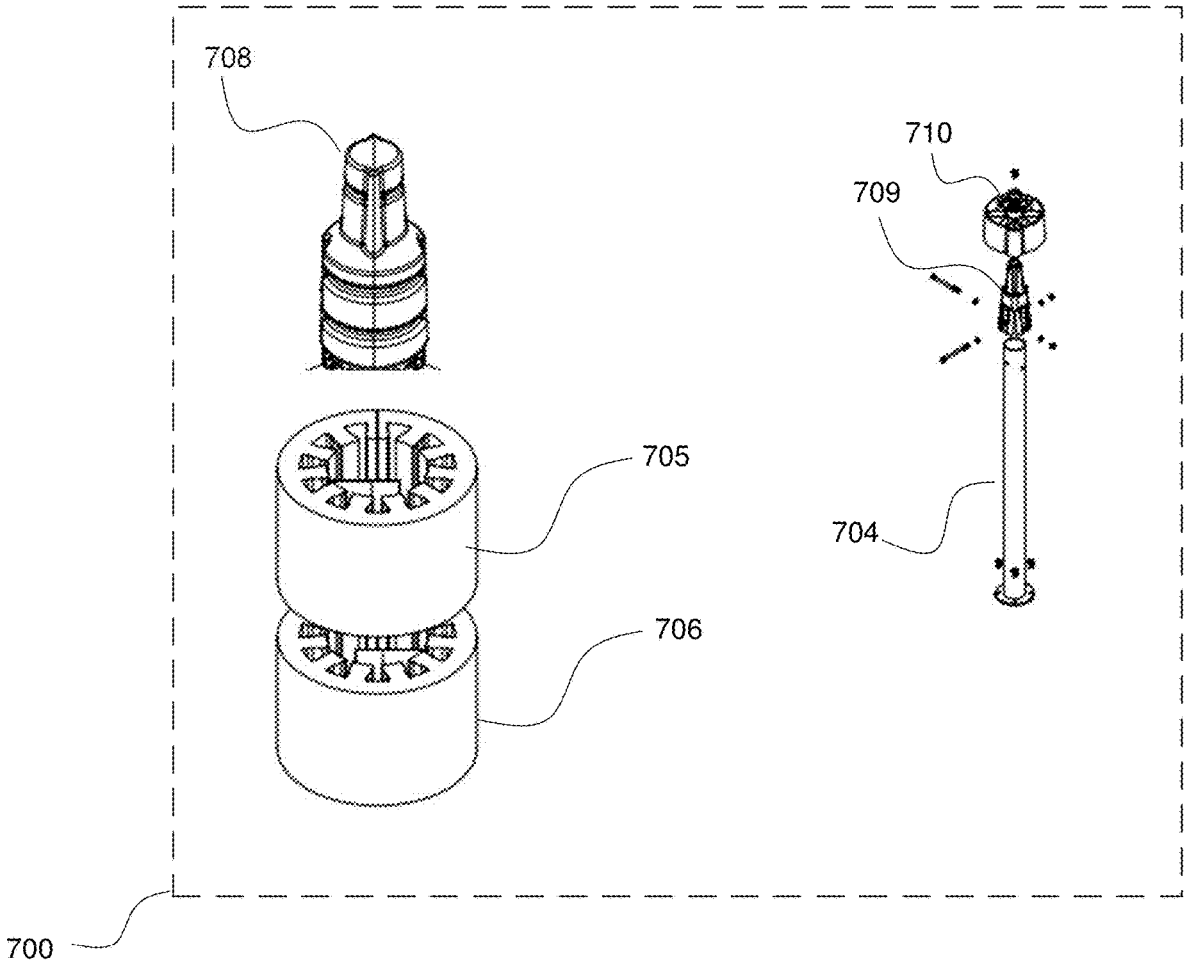
FIG. 7 illustrates an upper segment of the punching bag that is separated into individual components for inclusion within a single package according to various embodiments of the present disclosure.
Figure 8:
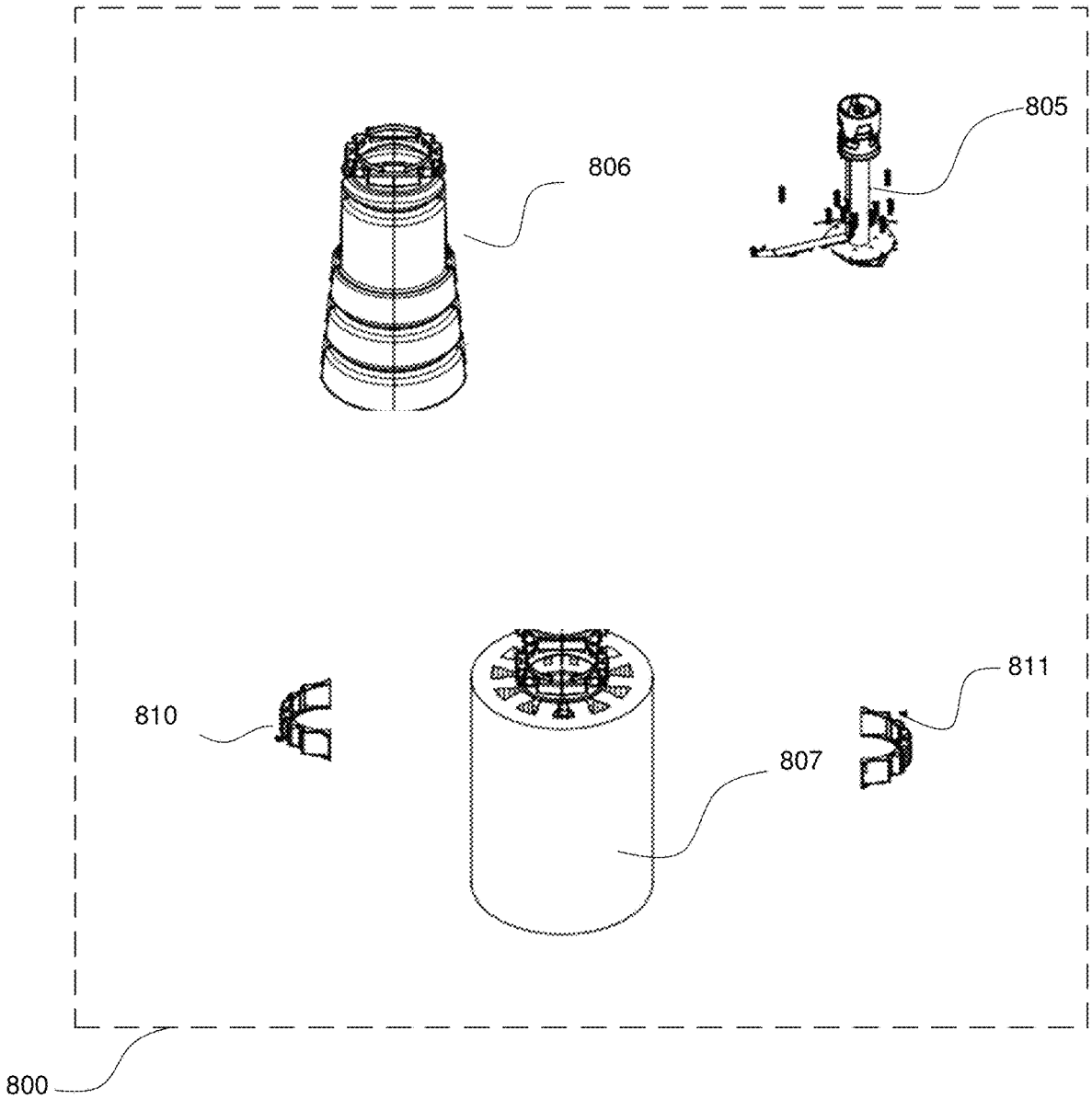
FIG. 8 illustrates a middle segment of the punching bag that is separated into individual components for inclusion within a single package according to various embodiments of the invention.
Figure 9:
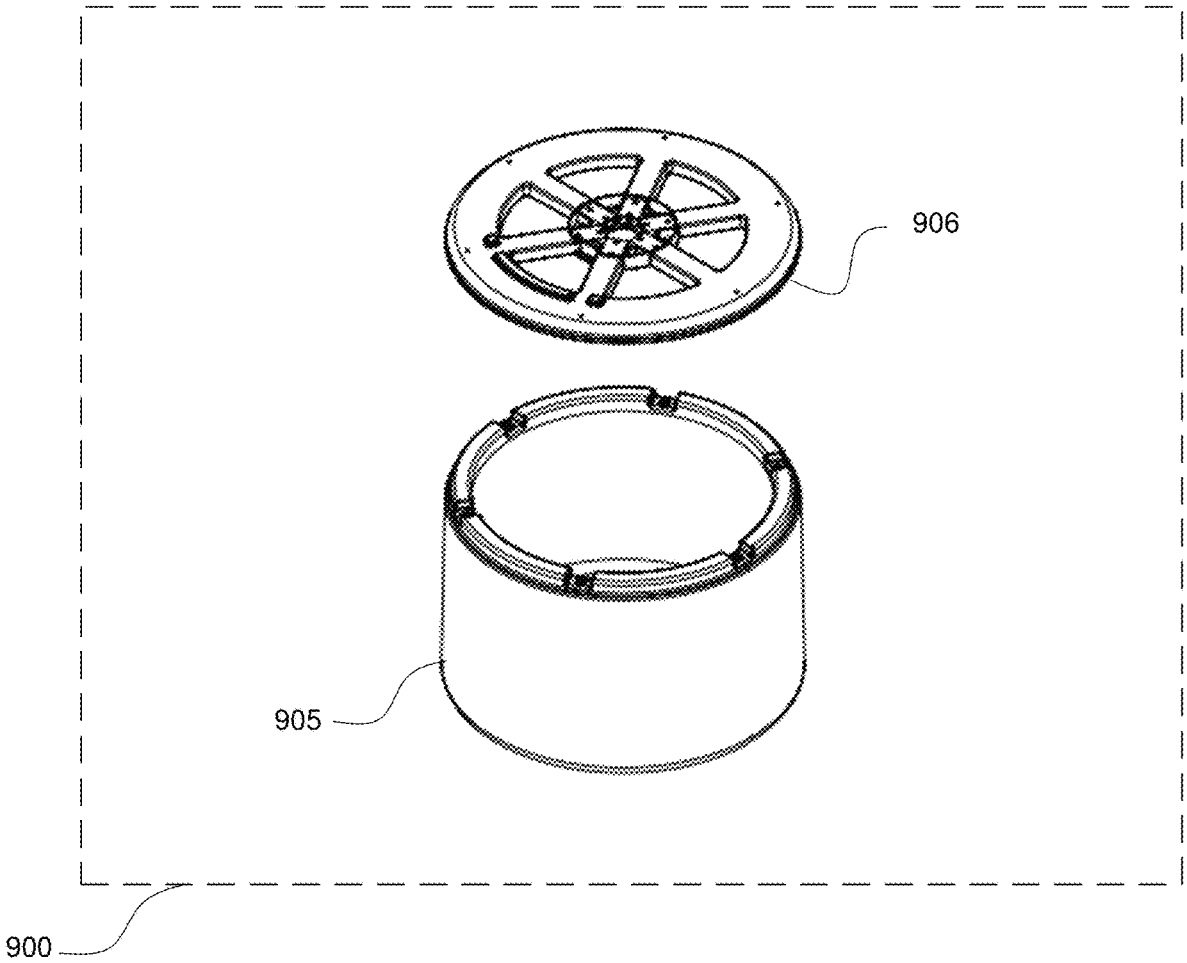
FIG. 9 illustrates a lower segment of the punching bag that is separated into individual components for inclusion within a single package according to various embodiments of the invention.

The punching bag components may be separated and grouped in accordance with various embodiments of the invention. This separation and grouping may be adjusted based on different versions or designs of the punching bag. Additionally, these components may be located within the package at various locations to create a preferred packaging assembly. The package comprises a package housing that includes walls in which components may be placed and secured. FIGS. 7-9 illustrate one embodiment in which these components are separated into three groups to enable preferred component positioning within the package. However, one skilled in the art will recognize that a punching bag may be separated into component parts in accordance with various embodiments of the invention and that these components may be subsequently assembled within a package using different techniques.

FIG. 7 illustrates a component grouping of an upper segment 700 of a punching bag in accordance with various embodiments of the invention. As shown, the upper segment 700 of the punching bag is disassembled into a first portion of durable material 705 used as a striking surface on the bag is selected along with a second portion of the durable material 706. In addition, the upper bag holder 708 is also identified as a component piece for packaging. The upper segment 700 of the punching bag further comprises a gimbal 710, a gimbal support 709 and upper weldment 704 are selected as component pieces for positioning within a densely arranged package. As previously mentioned, the upper segment 700 of may be disassembled into component pieces in a variety of ways, all of which are consistent with various embodiments of the invention.

FIG. 8 illustrates a component grouping of a middle segment 800 of a punching bag in accordance with various embodiments of the invention. As shown, the middle segment 800 of the punching bag is disassembled into a third portion of durable material 807, the lower bag holder 806, the first clamp 810 and the second clamp 811. The middle segment 800 of the punching bag is further separated into a lower weldment 805 that may comprise a spring and/or lock. One skilled in the art will recognize that the middle segment 800 may be separated into component pieces in a variety of ways, all of which are consistent with various embodiments of the invention.

FIG. 9 illustrates a component grouping of a lower segment 900 of the punching bag in accordance with various embodiments of the invention. As shown, the lower segment 900 of the punching bag is dissembled into a base top 906 and a base 905. One skilled in the art will recognize that the lower segment 900 may be separated into component pieces in a variety of ways, all of which are consistent with various embodiments of the invention.

Components of the punching bag are positioned within a package to reduce the package size in order to reduce the cost and complexity of shipping to a customer in accordance with various embodiments of the invention. The arrangement of these components within the package may be realized using a variety of different techniques, three of which are described below. However, these three examples are not intended to be exhaustive; rather, there are numerous other arrangements within the package that may achieve the goal of size reduction in accordance with different embodiments of the invention.

Figure 10:
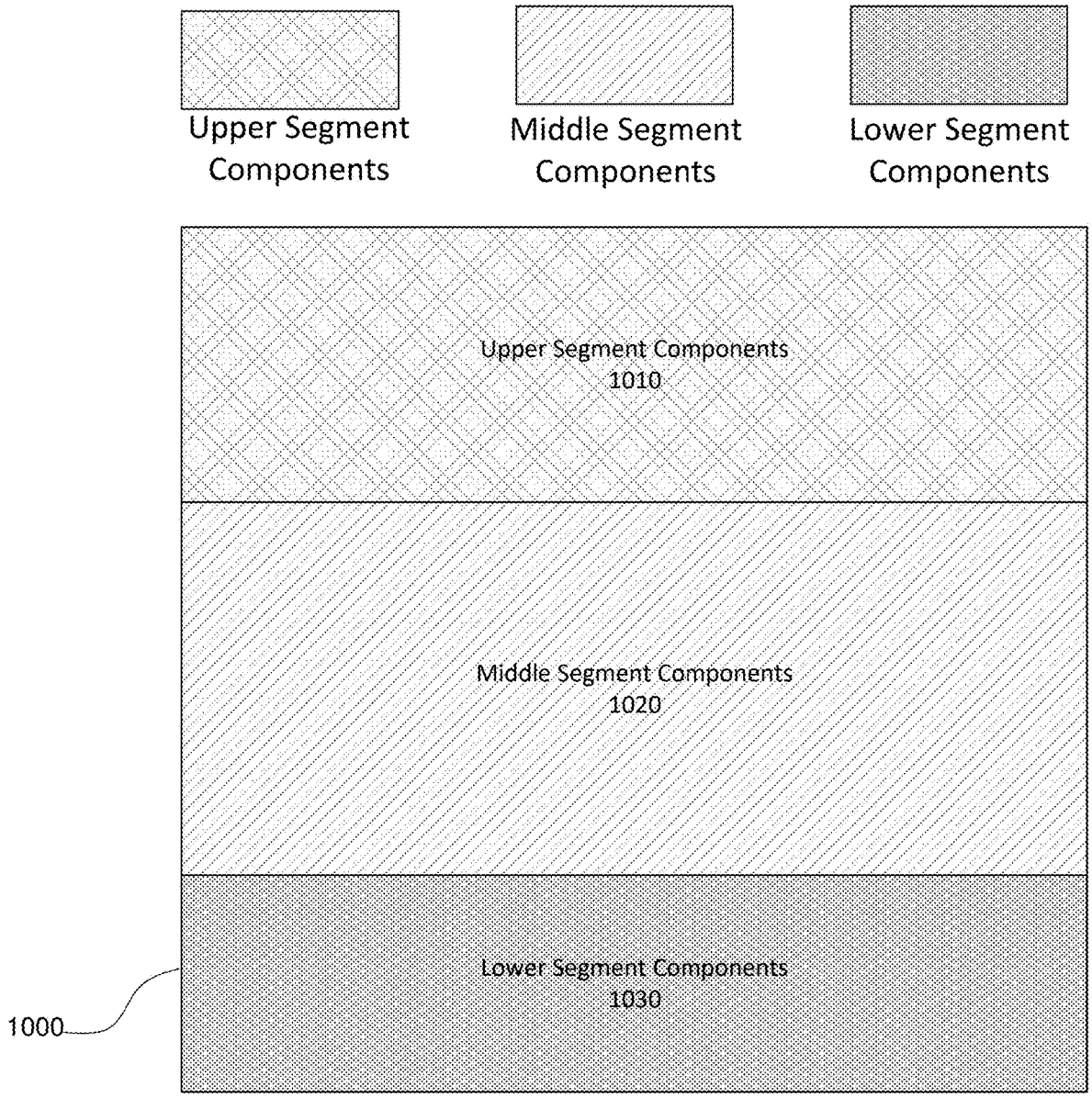
FIG. 10 illustrates a first packaging arrangement in which components are grouped together according to upper, middle and lower segment components according to various embodiments of the invention.

FIG. 10 illustrates a first example of component arrangement within a package according to various embodiments of the invention. In this embodiment, the punching bag components are organized within the package and grouped according to the punching bag segment to which each belongs. As show, the package 1000 comprises a first packaging area 1010 in which upper segment components are arranged, a second packaging area 1020 in which middle segment components are arranged and a third packaging area 1030 in which lower segment components are arranged. The components within each of these three packaging areas may be positioned in a preferred arrangement to realize a package size that improves the shipping costs of the punching bag to a customer. Additionally, one skilled in the art will recognize that the location of each of these packaging areas and the size of each of these packaging areas may change across different embodiments of the invention.

Figure 11:
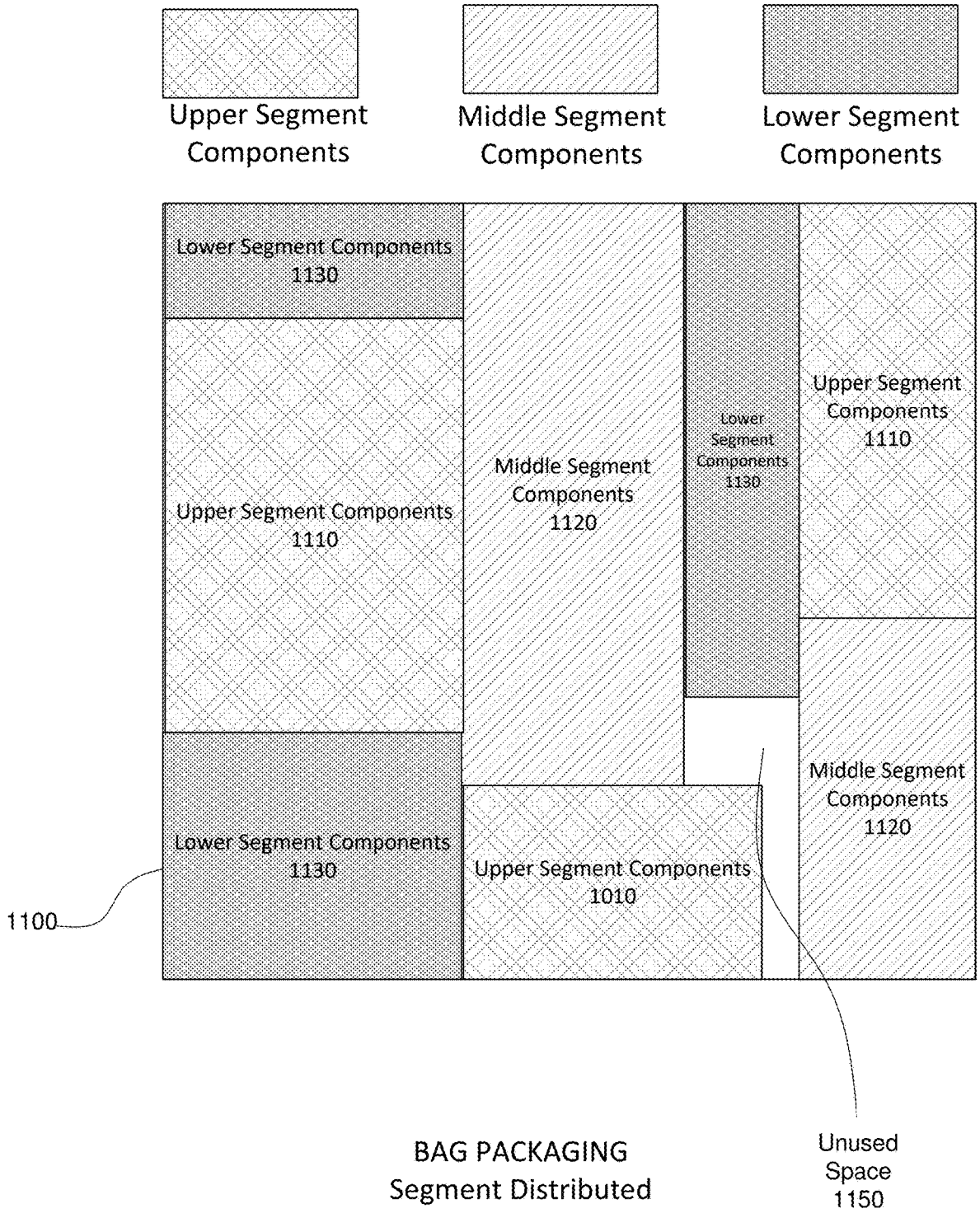
FIG. 11 illustrates a second packaging arrangement in which components are distributed within the package, the components are not fully grouped by upper, middle and lower segment components according to various embodiments of the invention.

FIG. 11 illustrates a second example of component arrangement within a package according to various embodiments of the invention. In many instances, a smaller packaging architecture results by distributing components within the package based on the size and shape of each component and not necessarily the segment of the punching bag from which the component belongs. As a result, many embodiments of the invention do not group components by segment within the package, but rather optimize the package by increasing component density to a preferred level.

As shown in FIG. 11, components within the lower segment 1130 of the punching bag are distributed throughout the package 1100 in a preferred arrangement to reduce the package size relative to a fully assembly punching bag or a segment grouped arrangement, an example of which is shown in FIG. 10. Components from the middle segment 1120 and from the upper segment 1010 are also distributed throughout the package, not based on the segment from which the component belongs, but in a preferred arrangement to reduce the overall size of the package.

Figure 12:
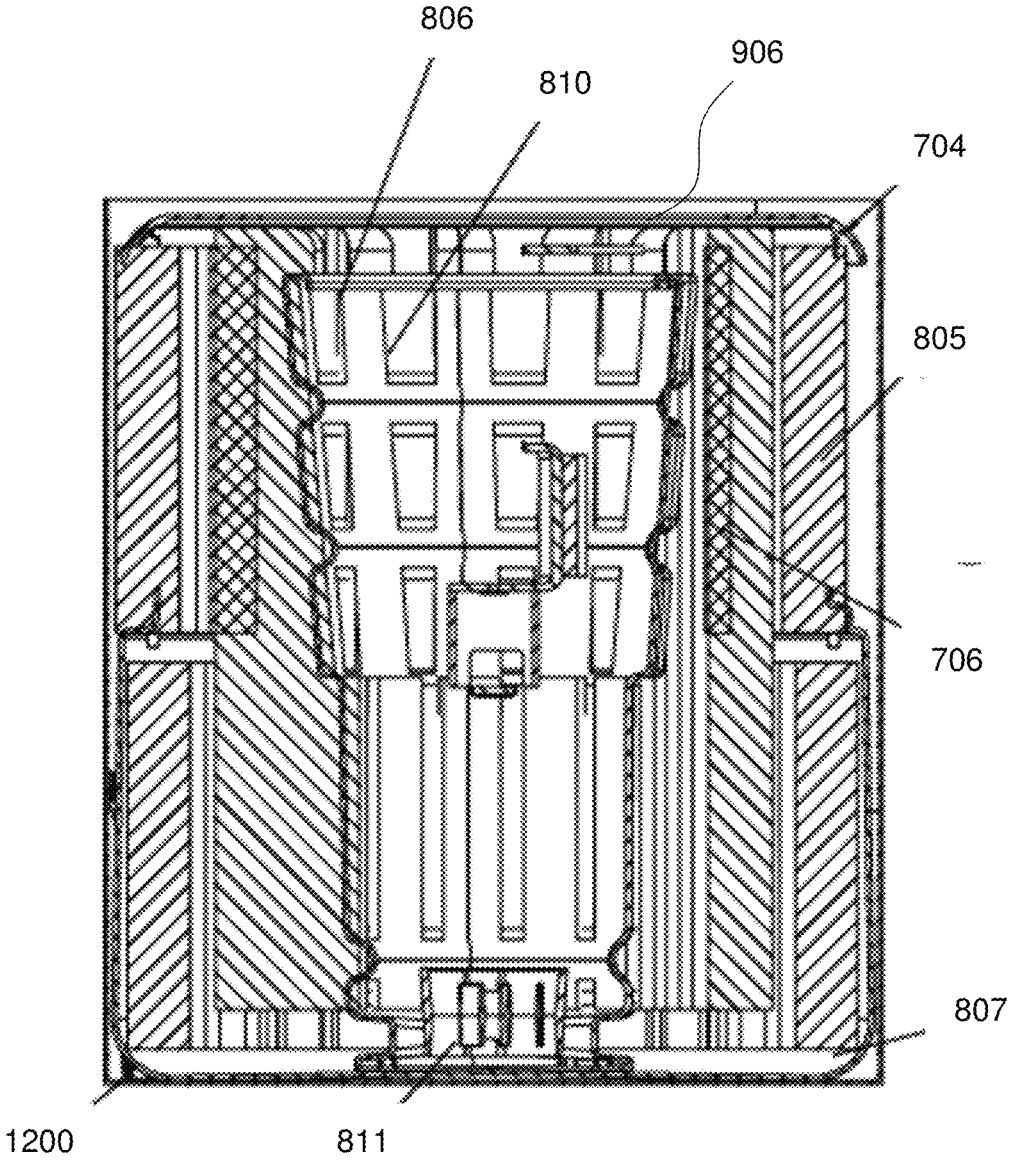
FIG. 12 illustrates a specific packaging arrangement in which the upper, middle and lower segment components are distributed in a three-dimensional arrangement including component nesting according to various embodiments of the invention.

FIG. 12 illustrates a very specific example of a packaging arrangement 1200 according to various embodiments of the invention. This is one example of a segment distributed arrangement described in FIG. 11 where components are distributed three-dimensionally within the package, not necessarily grouped by punching bag segment, and also includes certain instances of component nesting. Component nesting is defined where a component is entirely or partially inserted within another component within the package resulting in a higher component density within the package.

As shown, some of the components are shown within corresponding locations within the package. An upper weldment 704 and a second portion of the durable material 706 are visible within the package. Additionally, lower weldment 805, lower bag holder 806, the third portion of the durable material 807, the second clamp 811 are also strategically distributed within the package 1200. The base top 906 is also shown positioned within package 1200. Other components of the punching bag are also illustrated, but not labeled, such that each component of the punching bag is contained within the package 1200. In certain instances, there may be less than five components that are not contained within the package 1200 and provided to a customer in a separate package(s). Additionally, components may be nested within other components within the package 1200. For example, the lower bag holder 806 may comprise openings in which small components may be positioned. One skilled in the art will recognize that a variety of different nested and three-dimensional component arrangements may be realized across various embodiments of the invention.

One skilled in the art will recognize no computing system or programming language is critical to the practice or defining of component arrangements within certain embodiments of the present invention. It will be appreciated to those skilled in the art that the preceding examples and embodiments are exemplary and not limiting to the scope of the present disclosure. It is intended that all permutations, enhancements, equivalents, combinations, and improvements thereto that are apparent to those skilled in the art upon a reading of the specification and a study of the drawings are included within the true spirit and scope of the present disclosure. In particular, there may be a very large number of different component arrangements that reduce the size of the package relative to the size of a fully assembled punching bag. A determination of whether a component arrangement falls within the scope of embodiments of the invention may be determined by a comparison of the package having disassembled components arranged in the package relative to the size of a fully assembled punching bag such that the dissembled component package exterior area is 30% smaller than the outer area of a fully assembled punching bag. It shall also be noted that elements of any claims may be arranged differently including having multiple dependencies, configurations, and combinations.

What is claimed is:

1. A method for assembling a punching bag within a package, the method comprising:

identifying a plurality of components of a punching bag, the plurality of components comprising at least a majority of components used to construct a fully assembled punching bag;

arranging the plurality of components of the punching bag within a package, the arrangement of the plurality of components being distributed within the package having a first size, the first size being smaller than a second size corresponding to the fully assembled punching bag;

wherein at least one first component within the plurality of components is nested within at least one second component within the plurality of components, the at least one first component comprises a lower bag holder that is vertically dividable into halves for placement within the package; and wherein the plurality of components is distributed in the package using a segment grouped arrangement that groups the plurality of components into multiple segments according to one of the multiple segments to which each of the plurality of components belongs.

2. The method of claim 1 wherein the plurality of components comprises at least one of gimbal and shaft spring.

3. The method of claim 1 wherein the plurality of components comprises a plurality of sections of durable material, the durable material provides a striking surface for the assembled punching bag.

4. The method of claim 1 wherein the plurality of components comprises an upper weldment and a lower weldment.

5. The method of claim 1 wherein the plurality of components is distributed in the package using a three-dimensional arrangement.

6. The method of claim 1 wherein the first size is at least 20% smaller than the second size.

7. The method of claim 6 wherein the first size is at least 50% smaller than the second size.

* * * * *